US007934769B1

(12) United States Patent
Lin et al.

(10) Patent No.: US 7,934,769 B1
(45) Date of Patent: May 3, 2011

(54) SEAT FRAME FOR FOLDING CHAIR

(76) Inventors: Mei Chuen Lin, Taoyuan (TW); Tzu Mei Wang, Taoyuan (TW)

( * ) Notice: Subject to any disclaimer, the term of this patent is extended or adjusted under 35 U.S.C. 154(b) by 0 days.

(21) Appl. No.: 12/577,725

(22) Filed: Oct. 13, 2009

(51) Int. Cl.
*A47C 4/00* (2006.01)

(52) U.S. Cl. ..... 297/56; 297/452.18; 297/452.2; 297/452.38; 297/452.59; 297/440.22

(58) Field of Classification Search ..... 297/56, 297/452.18, 452.2, 452.38, 452.59, 463.1, 297/440.22
See application file for complete search history.

(56) References Cited

U.S. PATENT DOCUMENTS 1,600,248 A * 9/1926 Rosenthal et al. ..... 297/56
1,740,806 A * 12/1929 Clarin ..... 297/56
1,873,768 A * 8/1932 Kux ..... 297/56
1,975,622 A * 10/1934 Schermerhorn ..... 297/452.55

* cited by examiner

*Primary Examiner* — Laurie K Cranmer

(57) ABSTRACT

A seat frame for a folding chair includes a U-shaped front frame, a linear rear frame and a seat cushion. The front frame has a first support surface between an upper surface and a lower surface of the front frame, the first support surface having a contour the same as that of the front frame. The rear frame has a second support surface between an upper surface and a lower surface of the rear frame, the second support surface having a contour the same as that of the rear frame. The seat cushion is clamped between the first and second support surfaces in a horizontal position. The peripheral edges of the seat cushion are thereby in tight contact with the first and second support surfaces. Brackets are then used to connect the front frame and the rear frame that surround the seat cushion therein.

5 Claims, 4 Drawing Sheets

SEAT FRAME FOR FOLDING CHAIR

BACKGROUND OF THE INVENTION

1. Field of the Invention

The present invention generally relates to a seat frame for a folding chair, and more particularly to a folding chair having a seat cushion that is in horizontal contact with the seat frame, thereby distributing load uniformly and supporting high load.

2. The Prior Arts

FIG. 4 illustrates a conventional folding chair having a padded seat cushion. The seat frame includes a front frame A and rear frame B. The front frame A has a U-shaped contour. A bottom end of the front frame A bends upward to form a curved recess that defines a first support edge A1 having a same U-shaped contour as the front frame A. The rear frame B has a linear shape. A bottom end of the rear frame B bends upward to form a curved recess that defines a second support edge (its cross section is similar to that of the first support edge A1) having a same linear contour as the rear frame B. The seat cushion C typically includes a base made of plastics, wood, or like rigid materials on which a sponge or like soft material is laid and securely encapsulated in a leather layer. The seat cushion C is clamped between the first support edge A1 and the second support edge. A fastener element D is then used for securing the front frame A, seat cushion C, and rear frame B together, whereby the seat cushion C is sandwiched therebetween.

While the first support edge A1 and the second support edge form a frame adapted for placement of the seat cushion C, the contact between the first and second support edges and the seat cushion C is only a linear contact. As a result, the first and second support edges cannot provide the seat cushion C with a stable support. In case the fastener element got loose and a user sits on the chair, the seat cushion C is pressed downward, causing deformation of the two support edges in linear contact with the seat cushion C. As a result, the structure of the seat frame and its ability to provide support function may be adversely deteriorated.

SUMMARY OF THE INVENTION

A primary objective of the present invention is to provide a seat frame for a folding chair that can solve the aforementioned problems by achieving a surface contact rather than linear contact between the seat cushion and the support edges. Stable support can thereby be provided for the seat cushion, which reinforces its support capability. In addition, the support edges under loading will not easily deform.

In order to achieve the objective mentioned above, a seat frame for a folding chair according to the present invention includes a U-shaped front frame, a linearly rear frame and a seat cushion. The U-shaped front frame has a first support surface between an upper surface and a lower surface of the front frame, wherein the first support surface has a U-shaped contour that is similar to that of the front frame. The rear frame has a horizontal second support surface between an upper surface and a lower surface of the rear frame, wherein the second support surface has a linear contour that is similar to that of the rear frame. The seat cushion is clamped between the first support surface and the second support surface in a horizontal position. L-shaped brackets are then used for securely fixing the front frame, the seat cushion and the rear frame together, wherein the seat cushion is surrounded by the front frame and the rear frame.

The first support surface may be formed by providing two perpendicular bends from a bottom edge of the front frame.

The second support surface is formed by the same way. Further, the first support surface has a round portion at each of two distal ends of the U-shaped front frame for facilitating insertion of the seat cushion into the U-shaped first support surface.

Because the seat frame has the horizontal first and second support surfaces, the seat cushion can be clamped and supported in a stable manner and the support load can be distributed uniformly on the two horizontal support surfaces. Moreover, if the L-shaped brackets got loose and a user sits on the seat cushion, the support surfaces will not be subjected to deformation owing to the surface contact between the seat cushion and the support surface. Damages to the seat frame can therefore be prevented.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

Figure 1:
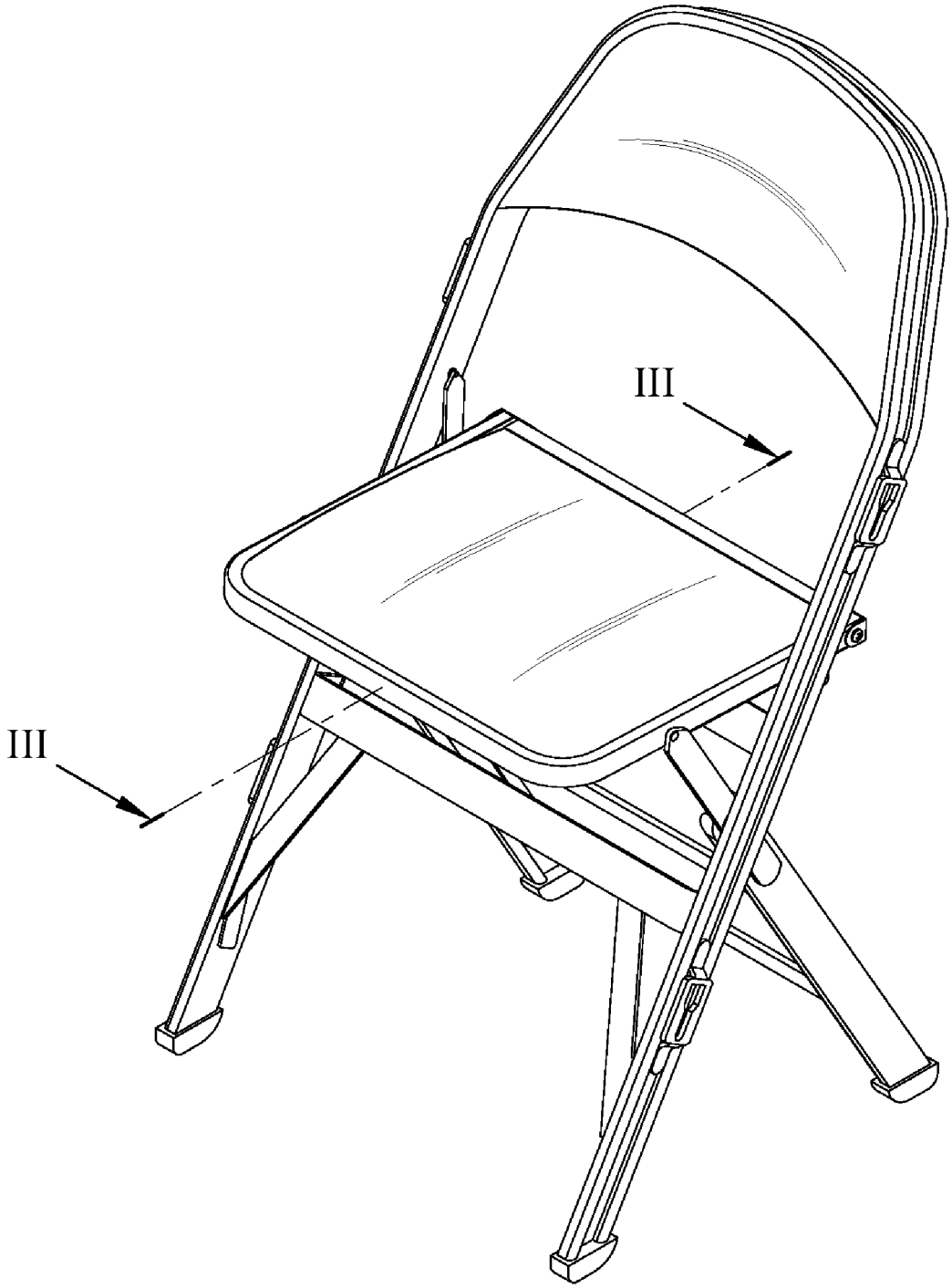
FIG. 1 is a perspective view illustrating a folding chair having a seat frame according to an embodiment of the present invention.

FIG. 1 is a perspective view illustrating a folding chair having a seat frame according to an embodiment of the present invention. The seat frame for the folding chair is used to hold a padded seat cushion 3. This seat cushion 3 includes a base made of plastics, wood, or like rigid materials on which a sponge or like soft material is disposed and securely encapsulated in a leather layer.

Figure 2:
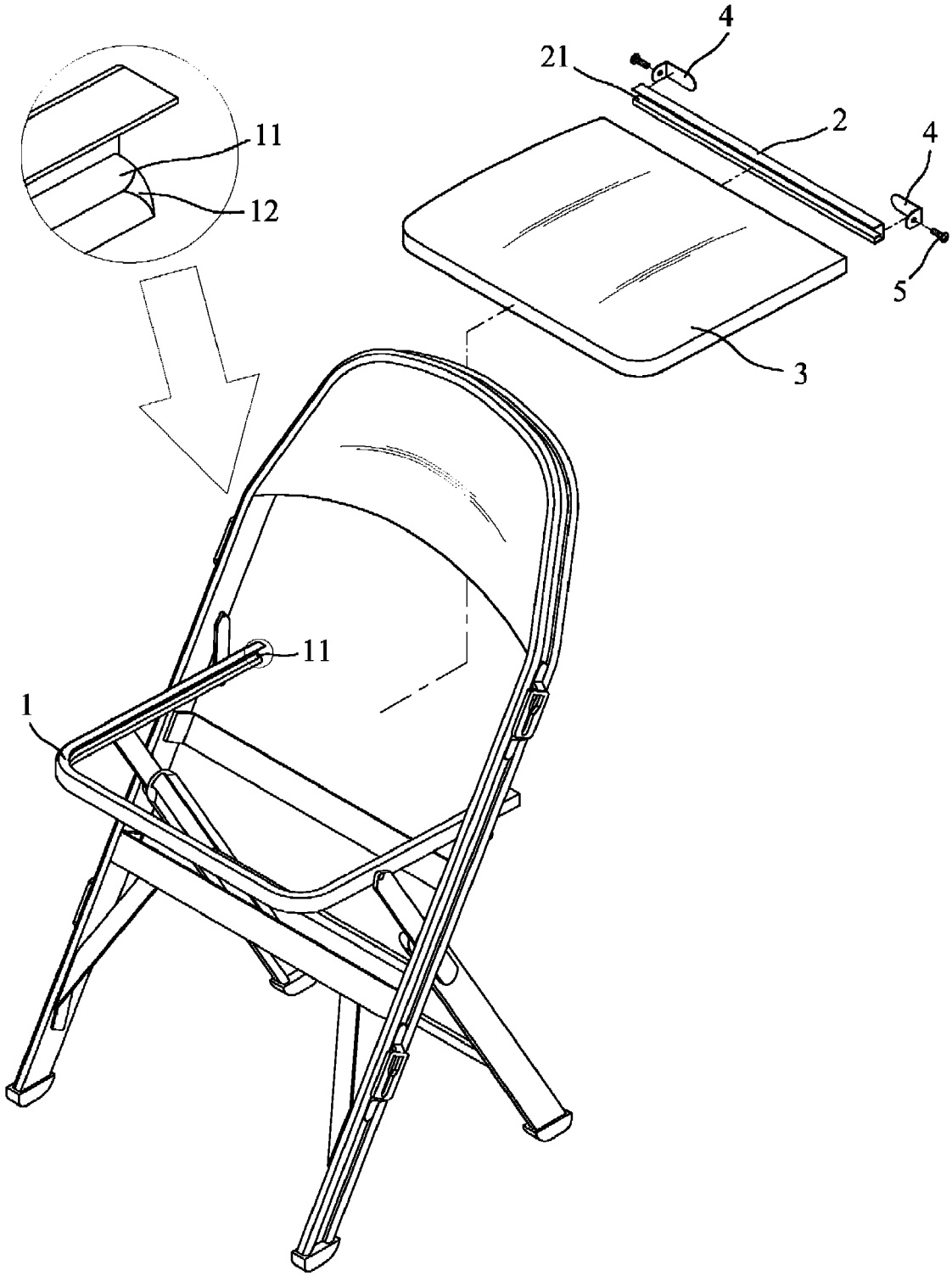
FIG. 2 is an exploded view illustrating the folding chair of FIG. 1.
Figure 3:
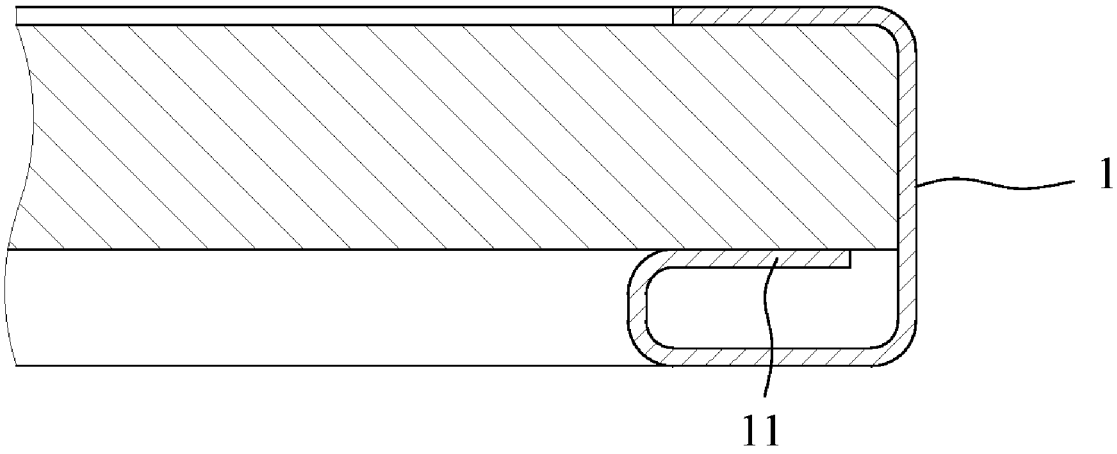
FIG. 3 is a cross sectional view taken along line III-III shown in FIG. 1.
Figure 4:
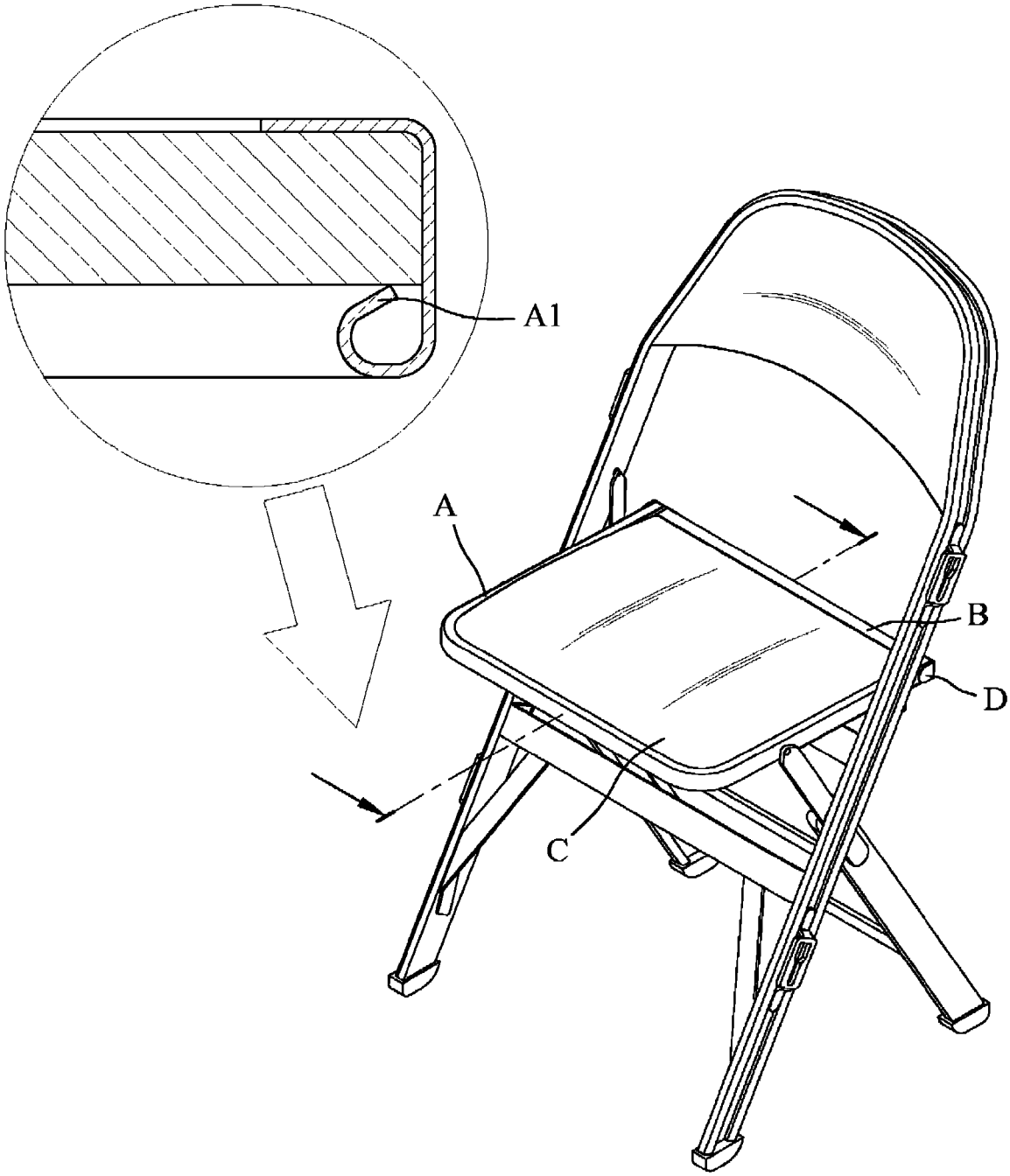
FIG. 4 (PRIOR ART)
FIG. 4 illustrates a folding chair having a conventional seat cushion.

Referring to FIG. 2, the seat frame for the folding chair according to the present invention includes a U-shaped front frame 1 and a linear rear frame 2. The contours of the front frame 1 and the rear frame 2 are corresponding to that of the seat cushion 3. Referring to FIGS. 2 and 3, a cross section of the front frame 1 is the same as that of the rear frame 2. The front frame 1 has an upper surface, a lower surface and a first support surface 11 located between the upper surface and the lower surface. The first support surface 11 is parallel to the upper surface and the lower surface of the front frame 1, and has a U-shaped contour the same as that of the U-shaped front frame 1. Similarly, the rear frame 2 has a second support surface 21 located between and parallel to an upper surface and a lower surface of the rear frame 2. The second support surface 21 has a linear contour the same as that of the rear frame 2. Referring to FIG. 3, the lower surface of the front frame 1 is extended and bent vertically upward and vertically inward to form the first support surface 11 that is parallel to the upper and lower surfaces of the front frame 1, thereby forming the G-shaped front frame 1. According to a second embodiment, the first support surface 11 is welded on to the front frame 1 and the first support surface 11 is parallel to the upper and lower surfaces of the front frame 1, thereby forming the E-shaped front frame 1 (not shown in Figures). Because the cross section of the front frame 2 is the same as that of the rear frame 1, the rear frame 2 are in G shape or E shape as the front frame 1. Further, the first support surface 11 has a round corner 12 at each of two distal ends of the U-shaped front frame 1. As shown in FIG. 3, the bottom surface of the seat cushion is parallel and flat with the first and second support surfaces to provide flat surface contact between the seat cushion and the first and second support surfaces as compared to linear contact in the prior art. The flat surface contact can support the seat cushion more reliably.

For assembling the seat cushion 3 with the seat frame, the two round portions 12 are used for guiding the insertion of the seat cushion 3 to a clamped position between the first support surface 11 and the upper surface of front frame 1. Three of the peripheral edges of the bottom surface of the seat cushion 3 are thereby clamped horizontally on the first support surface 11. The second support surface 21 of the rear frame 2 then clamps the fourth peripheral edge of the seat cushion 3. Accordingly, the first support surface 11 and the second support surface 21 can maintain a same height to form a horizontal placement surface. Two L-shaped brackets 4 securely connect the front frame 1 with the rear frame 2. A fastener member 5 then penetrate through one side of each of the two L-shaped brackets 4 for fixing the L-shaped bracket 4, front frame 1 and seat cushion 3 together.

After the assembly of the front frame 1 and the rear frame 2, the first support surface 11 and the second support surface 21 form horizontal support surfaces. Thus, the seat cushion 3 can be clamped and supported in a stable manner and the support load can be distributed uniformly on the two support surfaces. Moreover, if the L-shaped brackets 4 got loose and a user sits on the seat cushion 3, the support surface may at most displace downward in a resilient manner owing to the contact surface between the seat cushion 3 and the support surface. Because the support surface is not easily subjected to deformation, damages to the seat frame can be advantageously prevented.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A seat frame for a folding chair, comprising:

a U-shaped front frame having a first support surface between an upper surface and a lower surface of the front frame, wherein the first support surface has a U-shaped contour the same as that of the front frame, and the first support surface is parallel with the upper surface and the lower surface of the front frame;

a linear rear frame having a second support surface between an upper surface and a lower surface of the rear frame, wherein the second support surface has a linear contour the same as that of the rear frame, and the second support surface is parallel with the upper surface and the lower surface of the rear frame; and a seat cushion clamped between the first support surface and the second support surface in a horizontal position, wherein the front frame and the rear frame are assembled together for surrounding the seat cushion;

wherein the seat cushion has flat surface contact with the first and second support surfaces.

2. The seat frame as claimed in claim 1, wherein the lower surface of the front frame is extended and bent vertically upward and vertically inward to form the first support surface.

3. The seat frame as claimed in claim 2, wherein the first support surface has a round corner at each of two distal ends of the U-shaped front frame for facilitating insertion of the seat cushion.

4. The seat frame as claimed in claim 1, wherein the lower surface of the rear frame is extended and bent vertically upward and vertically inward to form the second support surface.

5. The seat frame as claimed in claim 1, wherein the front frame and the rear frame are securely fixed by two L-shaped brackets.

* * * * *